US009218798B1

(12) United States Patent
Satoh et al.

(10) Patent No.: US 9,218,798 B1
(45) Date of Patent: Dec. 22, 2015

(54) VOICE ASSIST DEVICE AND PROGRAM IN ELECTRONIC MUSICAL INSTRUMENT

(71) Applicant: KAWAI MUSICAL INSTRUMENTS MANUFACTURING CO., LTD., Hamamatsu-shi, Shizuoka (JP)

(72) Inventors: Takuya Satoh, Hamamatsu (JP); Kohtaro Ilimura, Hamamatsu (JP); Sachie Ilimura, Hamamatsu (JP)

(73) Assignee: KAWAI MUSICAL INSTRUMENTS MANUFACTURING CO., LTD., Hamamatsu-Shi (JP)

( * ) Notice: Subject to any disclaimer, the term of this patent is extended or adjusted under 35 U.S.C. 154(b) by 0 days.

(21) Appl. No.: 14/819,078

(22) Filed: Aug. 5, 2015

(30) Foreign Application Priority Data

Aug. 21, 2014 (JP) ..... 2014-168123

(51) Int. Cl.
*G10H 1/34* (2006.01)
*G10H 1/00* (2006.01)

(52) U.S. Cl.
CPC ..... *G10H 1/34* (2013.01); *G10H 1/0008* (2013.01); *G10H 2250/321* (2013.01)

(58) Field of Classification Search
IPC ..... G10H 1/34,1/0008, 2250/321
See application file for complete search history.

(56) References Cited

U.S. PATENT DOCUMENTS 3,575,555 A * 4/1971 Schanne ..... G10L 13/08 704/267
4,731,847 A * 3/1988 Lybrook ..... G10H 5/005 704/260
5,806,039 A * 9/1998 Fukada ..... G10H 1/0008 704/260
7,365,260 B2 * 4/2008 Kawashima ..... G10H 1/0041 704/258
2002/0016968 A1 * 2/2002 Nathan ..... G07F 17/0014 725/86
2004/0069117 A1 * 4/2004 Akins ..... G06F 1/1607 84/486
2005/0125833 A1 * 6/2005 Nathan ..... G06F 3/04847 725/95
2006/0206327 A1 * 9/2006 Hennecke ..... G10L 15/26 704/251
2006/0248105 A1 * 11/2006 Goradia ..... G10H 1/0008
2013/0204629 A1 * 8/2013 Nakanishi ..... G06F 3/01 704/275

FOREIGN PATENT DOCUMENTS

JP 3296518 4/2002

* cited by examiner

*Primary Examiner* — David Warren
(74) *Attorney, Agent, or Firm* — Christie, Parker & Hale, LLP

(57) ABSTRACT

Provided is a voice assist device in an electronic musical instrument in which tone selection or a sound setting corresponding to a key is performed in advance by pressing the operation button 1 while pressing one of the keys in the keyboard 2, including a changed state recognizing unit 3 that recognizes from a pressed key a changed state of tone selection or a sound setting determined corresponding to the key in advance, a setting item name storing unit 4 that stores a setting item name of the tone selection or sound setting as voice data, and a sound emitting unit 5 that emits a setting item name corresponding to the changed state, and the changed state recognizing unit 3 includes a voice assist recognizing unit 6 that detects a depression for a preset time or more of the operation button 1 prior to a depression of the key.

10 Claims, 6 Drawing Sheets

Fig.3

EXAMPLE OF TONE VOICE

| TONE DATA 1 | TONE DATA 2 | SEQUENCE DATA |
|---|---|---|
| BRILLIANCE | OFF | BRILLIANCE OFF |
| | MINUS | BRILLIANCE MINUS |
| | PLUS | BRILLIANCE PLUS |

Fig.4

| | |
|---|---|
| TONE | C4/E4/G4/C5 KEYBOARD, ARPEGGIO |
| REVERB SETTING | C5 KEYBOARD |
| DAMPER RESONANCE | C5/E5/G5/C6 KEYBOARD, ARPEGGIO |
| DAMPER NOISE | C5 KEYBOARD |
| STRING RESONANCE | PRESSING C4 KEYBOARD WHILE PRESSING G4/A4/B4/C5 KEYBOARD, ARPEGGIO |
| KEY ACTION NOISE | C4 KEYBOARD |

Fig.5

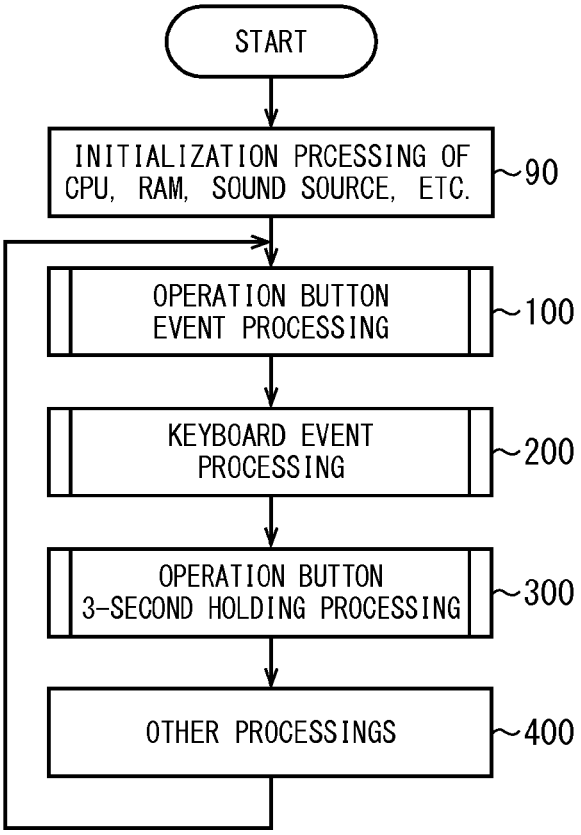

VOICE ASSIST DEVICE AND PROGRAM IN ELECTRONIC MUSICAL INSTRUMENT

CROSS-REFERENCE TO RELATED APPLICATION

This application claims priority to and the benefit of Japanese Patent Application No. 2014-168123, filed in the Japanese Patent Office on Aug. 21, 2014, the entire contents of which are incorporated herein by reference.

TECHNICAL FIELD

The present invention concerns an electronic musical instrument typified by a digital piano, and relates to a voice assist device that, when tone selection or a sound setting is changed in the electronic musical instrument, automatically emits its sample sound and a program that performs a voice assist in the electronic musical instrument.

BACKGROUND ART

An electronic musical instrument, as disclosed in, for example, Patent Literature 1, sends musical sound data generated by operating a keyboard or an operation panel to a sound source provided in an interior of the electronic musical instrument, produces a musical sound signal according to the musical sound data in the sound source, and produces a musical sound by converting it to an audio signal by a speaker. For the musical sound, a variety of tones from acoustic piano sounds to electronic pianos, electronic organs, and the like can be selected, and also, setting a reverb effect (reverb) as if playing in a concert hall or the like and/or setting an acoustic effect for a sound emission is possible. Moreover, the contents of a selected or set tone and reverb effect and/or acoustic effect have been displayed on an operation panel (display panel).

Also, in order to realize a more acoustic piano appearance or for a reduction in cost, some types of digital pianos (electronic musical instruments) are without operation panels (display panels) consisting of liquid crystal displays. When performing tone selection in such an electronic musical instrument, as shown FIG. 12, pressing an operation button (sound select key) 1 while performing a change by a key on a keyboard 2 is mainstream.

That is, pressing the operation button (sound select key) 1 while pressing any key of the keyboard 2 allows changing to a tone or a sound setting (setting of a reverb effect or acoustic effect) assigned in advance to each key. For example, pressing the operation button 1 while pressing a key A0 (tone selection) allows setting to the tone of a concert grand piano 1.

CITATION LIST

Patent Literature

Patent Literature 1: Japanese Patent No. 3296518

SUMMARY OF INVENTION

Technical Problem

When performing a change in tone selection or sound settings in an electronic musical instrument having the structure described above, it has been necessary to refer to its handling manual or operation guide as to which keys on the keyboard what setting items have been assigned to. Moreover, it has also been difficult when operating the electronic musical instrument with reference to the operation guide to instantaneously find out which key the keyboard displayed in the operation guide actually corresponds to.

Also, because the sound is not particularly emitted at the time of a setting change, it has been necessary, in order to confirm the change, to actually play the electronic musical instrument by pressing the keyboard.

Therefore, a problem has existed that a user of the electronic musical instrument feels it troublesome to perform a setting change by being interrupted.

Further, because it is difficult to recognize keys assigned for setting changes, pressing a key different from that for an objective setting change has been likely to occur.

The present invention has been made in view of the above-described actual circumstances, and it is an object of the present invention to provide a voice assist device and program in an electronic musical instrument that enables aurally confirming the content of an objective setting change by performing voice assistance of reading out by voice the content of a setting item corresponding to a key when changing tone selection or a sound setting (setting of a reverb effect or acoustic effect) in an electronic musical instrument.

Solution to Problem

To achieve the above object, the present invention of claim 1 is a voice assist device comprising, in an electronic musical instrument which includes a keyboard and an operation button to perform various settings and for which an operation setting corresponding to a key is performed in advance by pressing the operation button while pressing one of the keys in the keyboard, a changed state recognizing unit that recognizes from a pressed key a changed state of an operation setting determined corresponding to the key in advance;

a setting item name storing unit that stores a setting item name of the operation setting as voice data; and a sound emitting unit that emits a setting item name corresponding to the changed state, said changed state recognizing unit including a voice assist recognizing unit that detects a depression for a preset time or more of the operation button prior to a depression of the key, said sound emitting unit emitting the setting item name when the depression is detected.

The present invention of claim 2 is a voice assist device comprising, in an electronic musical instrument which includes a keyboard and an operation button to perform tone selection or a sound setting and in which tone selection or a sound setting corresponding to a key is performed in advance by pressing the operation button while pressing one of the keys in the keyboard, a changed state recognizing unit that recognizes from a pressed key a changed state of tone selection or a sound setting determined corresponding to the key in advance;

a setting item name storing unit that stores a setting item name of the tone selection or sound setting as voice data; and a sound emitting unit that emits a setting item name corresponding to the changed state, said changed state recognizing unit including a voice assist recognizing unit that detects a depression for a preset time or more of the operation button prior to a depression of the key, said sound emitting unit emitting the setting item name when the depression is detected.

claim 3 is the voice assist device according to claim 1 or claim 2, wherein the sound emitting unit notifies that a voice assist mode is applied when a depression for a preset time or more of the operation button is detected.

claim 4 is the voice assist device according to claim 3, wherein the notification is performed by speech.

claim 5 is the voice assist device according to claim 1 or claim 2, wherein the preset time is three seconds.

claim 6 is the voice assist device according to claim 2, comprising a phrase storing unit in which phrases of sounds by which an influence of the changed state is easily known are stored in plural numbers according to the changed state, wherein the sound emitting unit emits a phrase corresponding to the changed state, and thereafter emits a setting item name of the tone selection or sound setting.

claim 6 is a voice assist program for making a computer build the functions of the respective units according to claim 1 or claim 2.

Advantageous Effects of Invention

According to the voice assist device and program of the present invention, the content of an objective setting change can be aurally confirmed by performing voice assistance of emitting a setting item name corresponding to a changed state and reading out by voice the content of a setting item corresponding to a key when changing an operation setting or tone selection or a sound setting (setting of a reverb effect or acoustic effect) in an electronic musical instrument.

Also, by notifying that a voice assist mode is applied by the sound emitting unit, it can be recognized that pressing a key in this state allows receiving voice assistance.

By performing the notification by the sound emitting unit by speech, it can be aurally confirmed that a voice assist mode is applied.

By providing the preset time as three seconds, it can be accurately recognized to be a situation where a user has become stuck during the operation.

That is, if the operation button is pressed for three seconds or more prior to a depression of a key, it is recognized to be a situation where a user has become stuck during the operation and a voice assist mode is applied, and if less than three seconds, it is recognized that a user has understood which keys on the keyboard what setting items have been assigned to, and voice assistance is not performed.

By the sound emitting unit emitting a phrase corresponding to a changed state and thereafter emitting a setting item name of the tone selection or sound setting, a change in settings can be easily recognized.

BRIEF DESCRIPTION OF DRAWINGS

FIG. 3 is a table showing voice data corresponding to a sound setting (brilliance setting) when voice assistance is performed.

FIG. 4 is a table showing phrases of sample sounds corresponding to tone selection or sound settings when a sound preview is performed.

FIG. 5 is a flowchart showing an overall processing procedure in the voice assist device.

DESCRIPTION OF EMBODIMENTS

Hereinafter, a voice assist device in an electronic musical instrument according to an embodiment of the present invention will be described with reference to the drawings.

Figure 1:
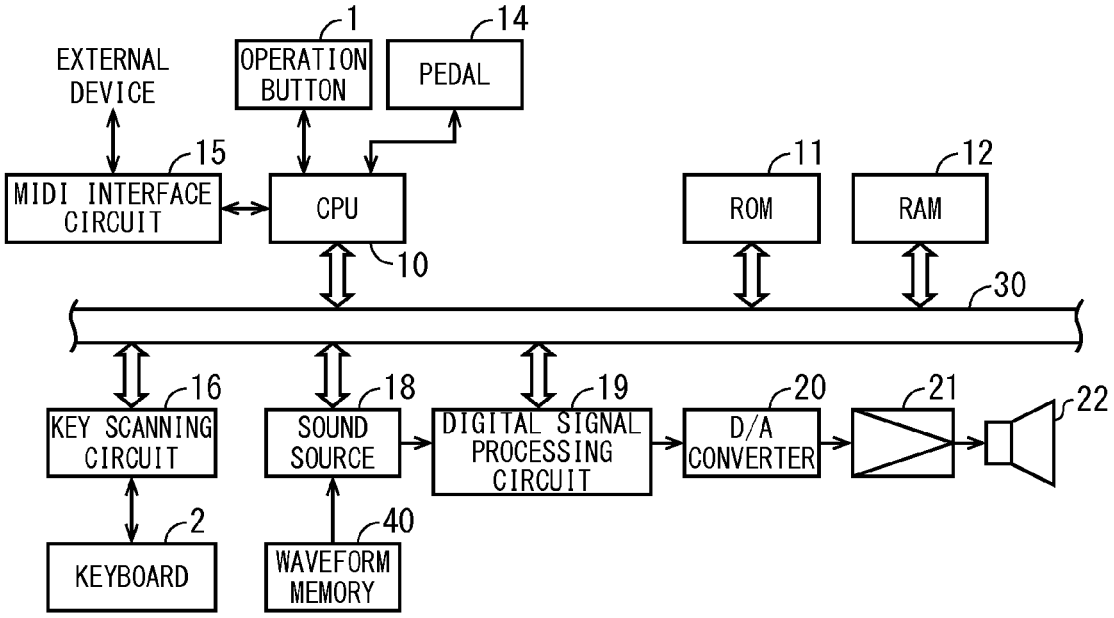
FIG. 1 is a block diagram showing a configuration of an electronic musical instrument in which a voice assist device of the present invention is mounted.

FIG. 1 is a block diagram showing a major hardware configuration of a digital piano (electronic musical instrument) mounted with the voice assist device, and in the configuration, a CPU 10, a ROM 11, a RAM 12, a key scan circuit 16, a sound source 18, and a digital signal processing circuit 19 are connected to a bus 30.

The CPU 10 controls the whole of the digital piano (electronic musical instrument) in accordance with a control program stored in the ROM 11. For example, the CPU 10 performs an assigner processing of assigning a sound emission channel to a key depression, an access processing with respect to the sound source 18, etc.

Also, to the CPU 10, an operation button 1 to be used for tone selection or a sound setting (setting of a reverb effect or acoustic effect), a pedal 14 for imparting a damper pedal effect to a sound emission, and a MIDI interface circuit 15 for performing MIDI data passing control with an external device are connected by dedicated lines.

The operation button 1 connected to the CPU 10 consists of an ON/OFF switch, and brings about an ON-state by sensing being depressed with software. Then, as described in the conventional art, by pressing the operation button 1 while pressing any key of the keyboard 2, various settings such as tone selection are performed.

The keyboard 2 is composed of a plurality of keys with which a player instructs pitches of musical sounds and key switches that open and close in conjunction with the keys. The keyboard 2 is connected to the key scanning circuit 16 that scans a state of the key switch to output the same as key data.

Figure 12:
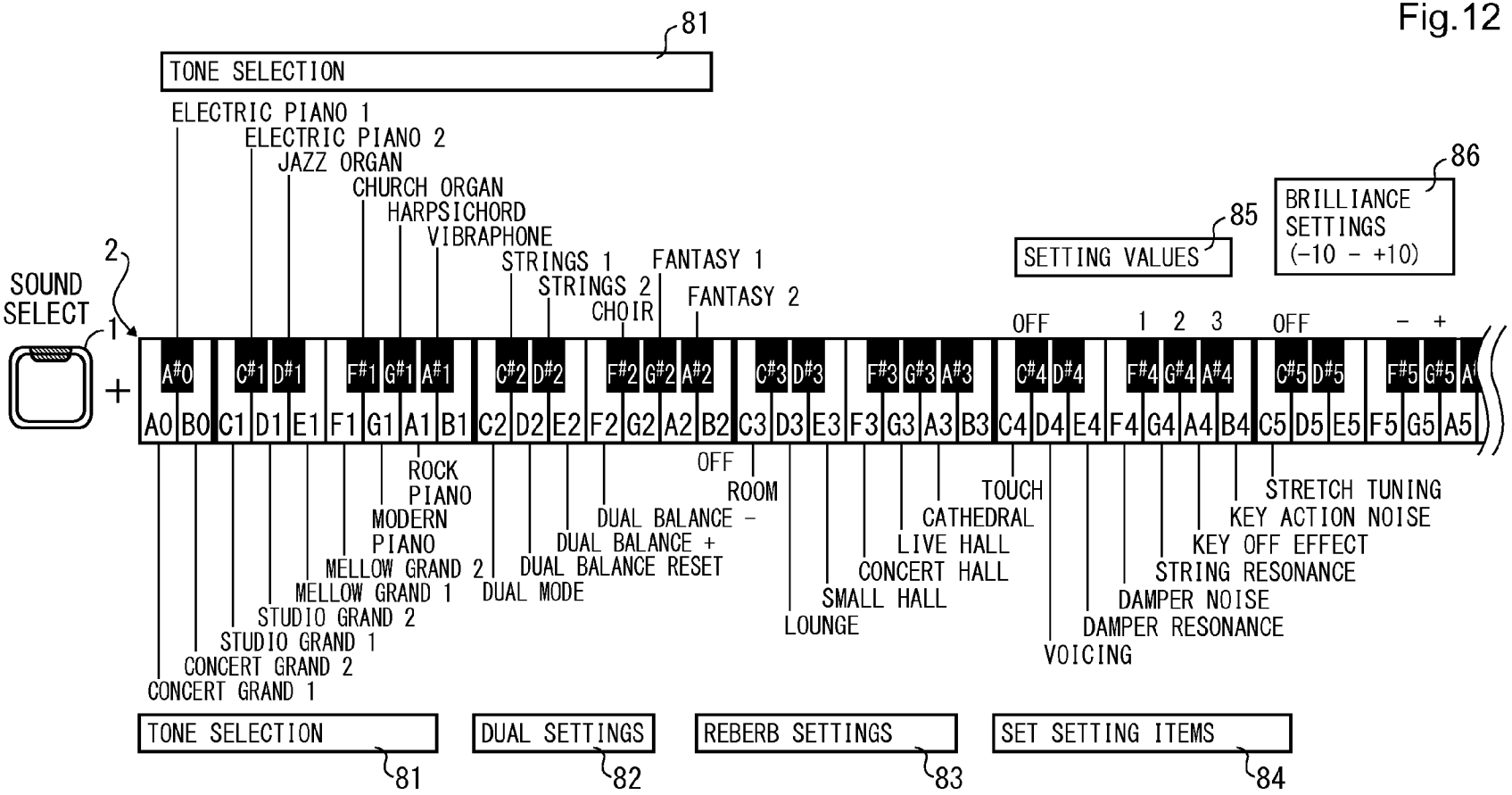
FIG. 12 is a model view showing assignment of a keyboard corresponding to tone selection or sound settings.

To the keys of the keyboard 2, as shown in FIG. 12, keys to perform tone selection 81, keys for dual settings 82 (to be selected when emitting different types of sounds in an overlapping manner), keys for reverb settings 83 (to select a reverb effect), keys to set setting items 84 (to select an acoustic effect by a key depression), keys to specify setting values 85 for an "OFF" setting to the above-mentioned setting item 84 or for setting volume levels "1," "2," and "3" when the item is set, and keys to perform a brilliance setting 86 (to adjust the brilliance of a tone) are made to correspond in advance.

The keys for the tone selection 81 allow selecting a tone to be used for a sound emission from among various tones such as, for example, pianos, organs, and flutes.

The keys for the dual settings 82 allow, besides selecting emitting different types of sounds (for example, a piano and an organ) in an overlapping manner, setting a proportion of the different sounds (which sound is set strong or weak), and resetting the proportion (bringing into a balanced state).

The keys for the reverb settings 83 allow selecting a reverb effect such that the vibrancy of sound (reverberation) in various chambers (such as, for example, a concert hall) can be reproduced.

Selection of an acoustic effect in the setting items 84 enables adjusting, for example, a volume change corresponding to the strength of a key depression, a change in sound due to the hardness of hammer strings and the like, etc. In the setting items 84, by selecting the respective keys corresponding to the setting values 85 ("OFF," "1," "2," and "3") after selecting an item, the volume and the rate of change can be adjusted.

The control keys corresponding to the brilliance setting 86 ("OFF," "–," and "+") allow adjusting the brilliance of a tone.

The pedal 14 connected to the CPU 10 consists of, for example, a foot pedal, and detects a stepping amount (pedal position data) by a detector provided in the pedal to send out the same to the CPU 10. The pedal position data is temporarily stored in the RAM 12, and used for controlling the degree an acoustic effect is displayed.

The ROM 11 stores various programs (for example, a voice assist program and a sound preview program), various data, etc., to be executed or referred to by the CPU 10. The programs and data stored in the ROM 11 are referred to by the CPU 10 via the system bus 30. That is, the CPU 10 is structured so as to read out a control program (command) from the ROM 11 via the system bus 30 and interpret and execute the same, and so as to read out predetermined fixed data to use the same for an arithmetic processing.

Also, in the ROM 11, a phrase (sound emission data) that is emitted as a sample sound in a sound preview is saved as sequence data. The phrase (sound emission data) consists of data to emit a sound by which the content of a setting is easily known depending on the type such as a tone setting, a reverb effect setting, or an acoustic effect setting. The details of the types of phrases (sound emission data) that are set for every setting of the tone settings, reverb effect settings, and acoustic effect settings will be described later.

The RAM 12 is used as a working memory that temporarily stores various data necessary for the CPU 10 to execute a program. For example, operation processing data by the operation panel 1, key data taken from the keyboard 2, pedal position data taken from the pedal 14, etc., are temporarily stored in the RAM 12. The data stored in the RAM 12 is referred to by the CPU 10 via the system bus 30.

The key scan circuit 16 scans a state of the key switch of the keyboard 2, and outputs the same as key data indicating an ON/OFF state of the key. The key data is sent to the CPU 10 via the system bus 30, and temporarily stored in the RAM 12.

The key data stored in the RAM 12 is referred to at a predetermined timing.

The key data is, when it is in a state in which the operation button 1 has been pressed, used as data to perform tone selection, a sound setting, or the like based on a key number identifying a key where an event has occurred.

On the other hand, when it is in a state in which the operation button 1 has not been pressed, the key data is used for generating a key number identifying a key where an event has occurred and touch data indicating the strength (speed) of a key depression. The created key number and touch data are converted to frequency data and envelop data and sent to the sound source 18, and are used for a key depressing/key releasing processing or the like associated with key-on/key-off.

The sound source 18 is driven in accordance with musical sound data (a waveform address created corresponding to a tone number, frequency data created corresponding to a key number, envelop data created based on touch data and pedal position data, etc.) sent from the CPU 10 and a phrase (sound emission data) and generates a digital musical sound signal by time division. The digital musical sound signal generated by the sound source 18 is output to the digital signal processing circuit 19.

A waveform memory 40 consists of, for example, a ROM, and has waveform data applied with pulse code modulation (PCM) stored therein. The waveform memory 40 has stored therein, in order to realize a plurality of tones, a plurality of types of waveform data (identified by tone number) corresponding to the respective tones. The waveform data stored in the waveform memory 40 is read out by the sound source 18.

The digital signal processing circuit 19 outputs a digital musical sound signal input from the sound source 18 and a coefficient input from the CPU 10 after performing a predetermined arithmetic processing therebetween. For example, a coefficient determined by a stepping amount of the damper pedal and the digital musical sound signal are subjected to an arithmetic processing to generate a digital musical sound signal imparted with a predetermined damper pedal effect. The digital musical sound signal generated by the digital signal processing circuit 19 is supplied to a D/A converter 20.

The D/A converter 20 converts the digital musical sound signal supplied from the sound source 18 to an analog musical sound signal. The analog musical sound signal output by the D/A converter 20 is sent out to an amplifier 21.

The amplifier 21 outputs the input analog musical sound signal after amplifying at a predetermined amplification factor. The analog musical sound signal subjected to predetermined amplification by the amplifier 21 is supplied to a speaker 22.

The speaker 22 converts an analog musical sound signal being an electrical signal to an acoustic signal. That is, by the speaker 22, a voice data and a phrase (sound emission data) according to the type such as a tone setting, a reverb effect setting, or an acoustic effect setting is emitted, or a musical sound corresponding to a depression of each key of the keyboard 2 is emitted with an acoustic effect corresponding to a stepping amount of the pedal 14 imparted.

Figure 2:
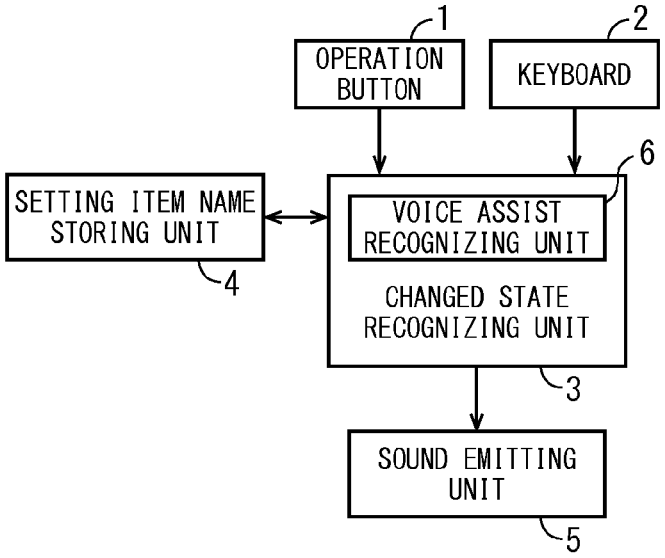
FIG. 2 is a functional block diagram showing a configuration of a voice assist device of the present invention.

FIG. 2 is a functional block diagram of a voice assist device built inside a digital piano (electronic musical instrument) by a voice assist program and a sound preview program stored in the ROM 11 in the block diagram of FIG. 1.

A voice assist function is a function that automatically emits by voice the content of a setting item when changing tone selection or a sound setting in a digital piano. This voice assist function is realized by including an operation button 1, a keyboard 2, a changed state recognizing unit 3, a setting item name storing unit 4, and a sound emitting unit 5. Also, the changed state recognizing unit 3 that recognizes a changed state of tone selection or a sound setting includes a voice assist recognizing unit 6 that determines whether to perform voice assistance.

A sound preview function is a function that, when tone selection or a sound setting is changed in a digital piano, automatically emits its sample sound as a phrase. This sound preview function is realized by data of sample sounds determined for every content of settings being stored in the setting item name storing unit 4 as phrases (sound emission data).

The operation button 1 and the keyboard 2 are used when changing tone selection or a sound setting. That is, as described above, by pressing the operation button 1 while pressing one of the keys in the keyboard 2, tone selection or a sound setting corresponding to the key is performed in advance.

The changed state recognizing unit 3 is for a processing to be executed in the CPU 10 by a voice assist program and a sound preview program stored in the ROM 11, and recognizes from a pressed key a changed state of tone selection or a sound setting determined corresponding to the key in advance when a depression of the operation button 1 and a key (any key on the keyboard 2) is detected, and takes in sound emission data corresponding to the changed state from the phrase storing unit 4.

The voice assist recognizing unit 6 is for a processing to be executed in the CPU 10 by a voice assist program stored in the ROM 11, and recognizes that voice assistance is necessary when a depression of the operation button 1 for a preset time (for example, three seconds) or more is detected. The depressing time of the operation button 1 is set as three seconds or more because this is time suitable for judging whether it is in a situation where a user has become stuck during the operation. Thus, a voice assist mode is applied if the holding time by a depression is three seconds or more, and if less than three seconds, it is recognized that the user has understood which keys on the keyboard what setting items have been assigned to, and voice assistance is not performed.

The setting item name storing unit 4 is provided inside the ROM 11 in the block diagram of FIG. 1, and has stored therein regarding tone and sound settings, voice data corresponding to respective setting items. That is, for the voice data, "concert grand 1," "modern piano," "jazz piano," "concert hall," "damper resonance," etc., being setting items corresponding to the respective keys of FIG. 12 are stored as voice data. These pieces of original voice data are segmented into units of words and stored in the waveform memory 40, and in the setting item name storing unit 4, sequence data for which the words are joined together is stored.

For example, in the case of voice data that is emitted by respective keys "C#5" (OFF), "F#5" (minus), and "G#5" (plus) corresponding to the brilliance setting 86 of the setting item, as shown in FIG. 3, "brilliance" is stored as voice data 1 in the waveform memory 40, "OFF," "minus," and "plus" are stored as voice data 2, and as the sequence data, "brilliance off," "brilliance minus," and "brilliance plus" are saved.

Also, the setting item name storing unit 4 has stored therein according to a changed state sample sounds of phrases of sounds by which the influence thereof is easily known in plural numbers. Examples of the sample sounds according to setting changes are shown in FIG. 4.

For example, as a phrase when a setting change is performed by respective keys (such as A0 to A1) corresponding to the tone selection 81, an Arpeggio consisting of C4, E4, G4, and C5 pitches (playing a chord of do, mi, sol, and do in order from the low-pitched tone) is stored as sound emission data. This is because, in the case of a tone, a sound emission of a chordal Arpeggio makes a difference easy to be recognized.

As a phrase when a setting change is performed by respective keys (B2 to A3) corresponding to the reverb settings 83 regarding a reverb effect, sound emission data by which only the C5 pitch (do) is emitted is stored. This is for making a difference in reverberations of "do" easy to be recognized by emitting a sole "do."

As a phrase when a setting change is performed by a key E4 corresponding to a damper resonance setting of the setting items 84, an Arpeggio consisting of C5, E5, G5, and C6 pitches (playing a chord of do, mi, sol, and do in order from the low-pitched tone) is stored as sound emission data. In addition, do, mi, sol, and do to be emitted in the case of the damper resonance setting is of an interval one octave higher than that of do, mi, sol, and do to be emitted in the case of the tone setting.

As a phrase when a setting change is performed by a key F4 corresponding to a damper noise setting of the setting items 84, sound emission data by which only the C5 pitch (do) is emitted is stored.

As a phrase when a setting change is performed by a key G4 corresponding to a string resonance setting of the setting items 84, an Arpeggio consisting of G4, A4, B4, and C5 pitches (playing a chord of sol, la, ti, and do in order from the low-pitched tone) to be emitted with a key C4 (do) pressed is stored as sound emission data. This is for catching a resonance with respect to the key C4 (do).

As a phrase when a setting change is performed by a key B4 corresponding to a key action noise setting of the setting items 84, sound emission data by which only the C4 pitch (do) is emitted is stored.

The sound emitting unit 5 corresponds to the sound source 18, the digital signal processing circuit 19, the D/A converter 20, the amplifier 21, and the speaker 22 in the block diagram of FIG. 1, and emits a phrase of sound emission data corresponding to a changed state taken from the phrase storing unit 4 by the changed state recognizing unit 3.

Next, the operation of the digital piano described above will be described in detail with reference to the flowcharts shown in FIG. 4 and FIG. 5, mainly on the voice assist function and the sound preview function.

FIG. 5 is a main flowchart showing various processings in a digital piano (an electronic musical instrument), and the processing is started by power-on. That is, when the digital piano is powered on, first, an initialization processing of the CPU 10, the RAM 12, the sound source 18, etc., is performed (step 90).

In the initialization processing, a clearing processing of registers and flags in an interior of the CPU 10, an initial value setting processing for various buffers, registers and flags, etc., defined inside the RAM 12, a process of setting an initial value for the sound source 18 to prevent an unnecessary sound from being emitted, etc., are performed.

Next, an operation button event processing is performed (step 100).

In the operation button event processing, whether there is application of voice assistance and a start of implementing the sound preview function are selected by a depressing operation of the operation button 1.

Figure 6:
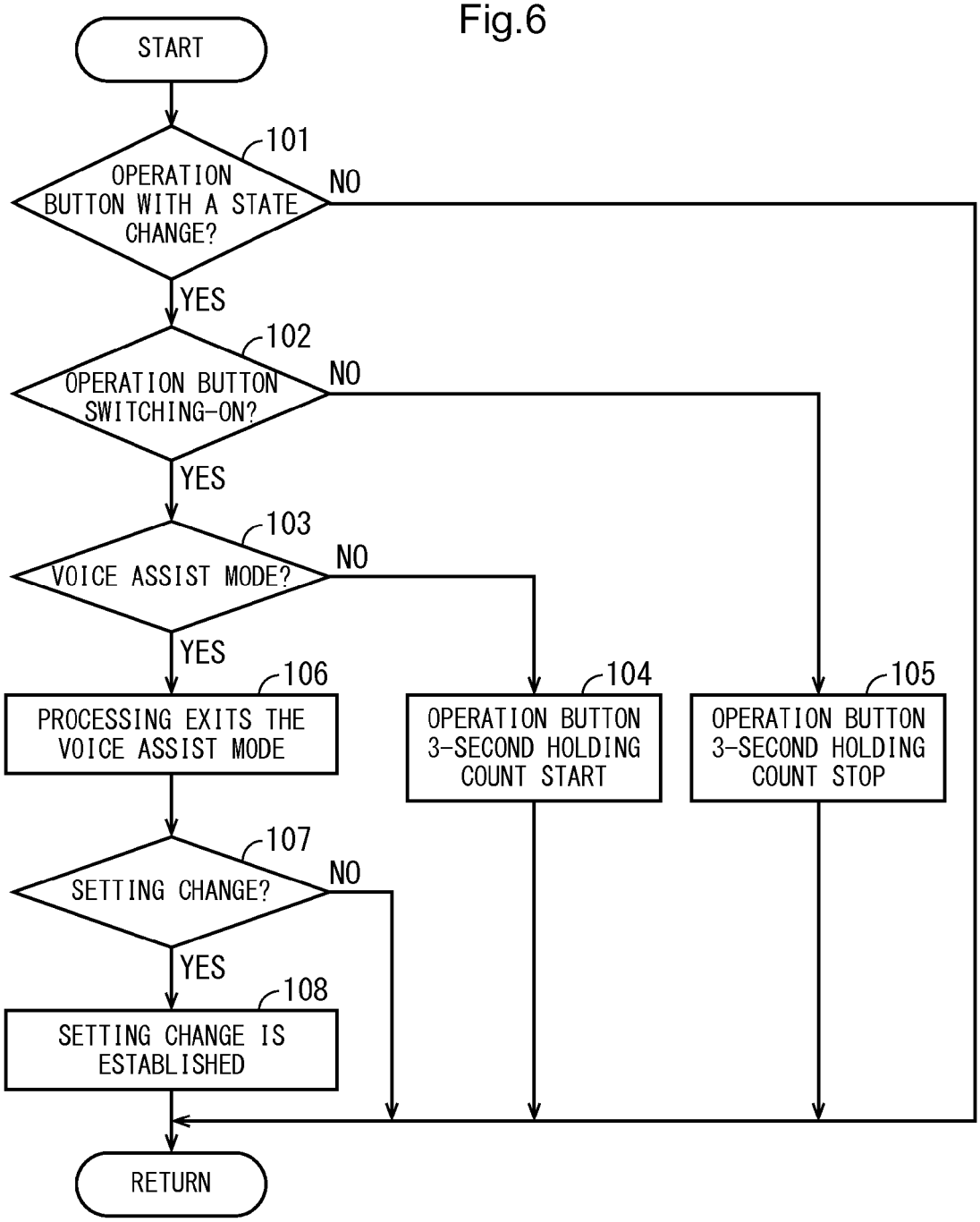
FIG. 6 is a flowchart showing a procedure of an operation button event processing in the voice assist device.

That is, in the operation button event processing, as shown in the flowchart of FIG. 6, first, whether the operation button 1 has been "ON- or OFF-operated" is judged (step 101). If the operation button 1 is "not operated at all" (without a state change) without being ON- or OFF-operated, the processing exists the flowchart from RETURN.

If the operation button 1 has been "ON- or OFF-operated" (with a state change), it is subsequently detected whether there is a depression (switching-on) of the operation bottom 1 (step 102).

If the operation button 1 has been depressed, whether it is in a voice assist mode where voice assistance is performed is judged (step 103).

If it is not yet in the voice assist mode, a count as to whether the operation button 1 is held for three seconds starts (step 104).

On the other hand, if there is not a depression of the operation button 1 in step 102, the count as to whether the operation button 1 is held for three seconds is stopped (step 105).

If it is already in the voice assist mode in step 103, the processing exits the voice assist mode (step 106).

Whether the setting content of a setting item has been changed is judged (step 107), and if a setting change has been performed, the content of the setting change is established (step 108).

Next, returning to FIG. 5, a keyboard event processing is performed (step 200) subsequent to the operation button event processing.

Figure 7:
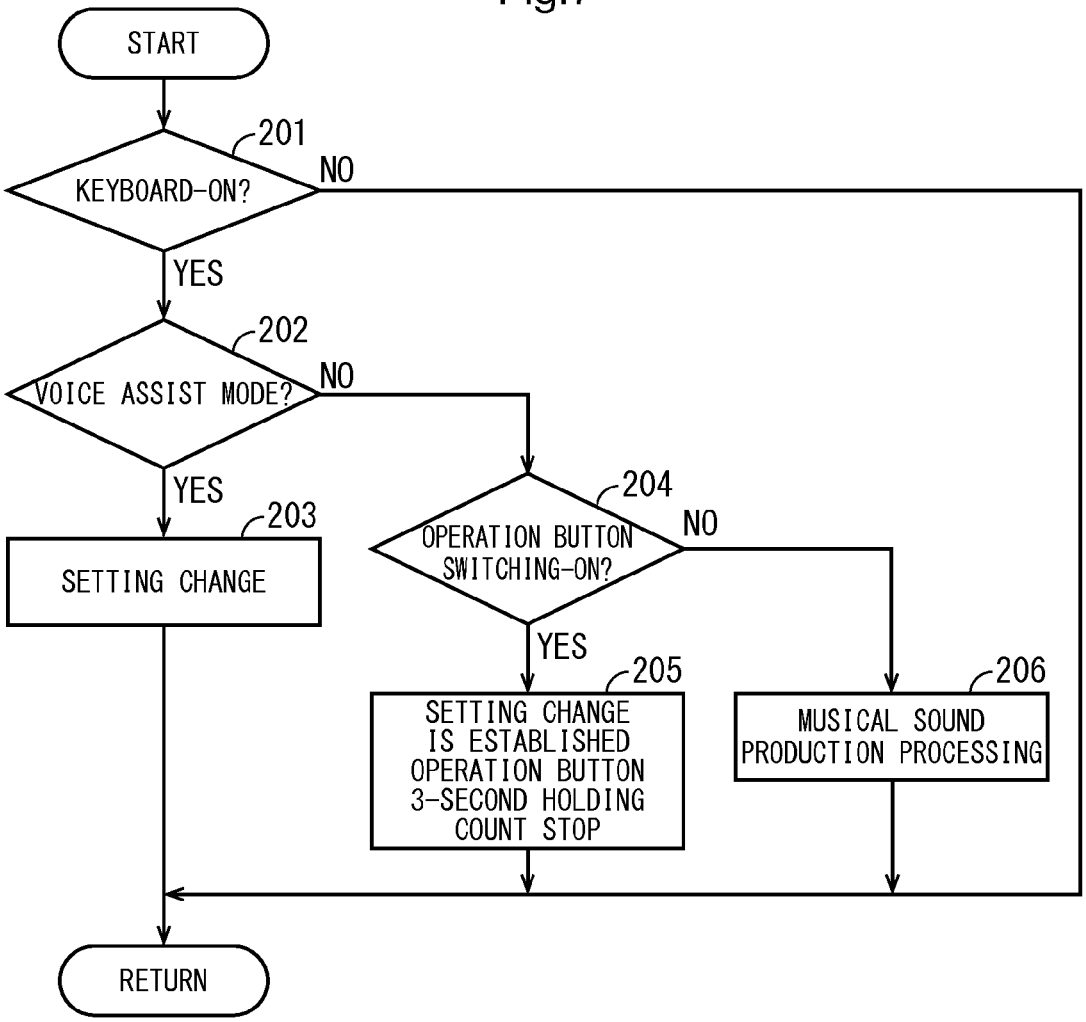
FIG. 7 is a flowchart showing a procedure of a keyboard event processing in the voice assist device.

In the keyboard event processing, operations regarding the keyboard 2, that is, a processing corresponding to a setting operation such as tone selection or a sound setting and a sound emitting operation by a depression of each key on the keyboard are performed. A processing procedure of the keyboard event processing is shown in FIG. 7.

In the keyboard event processing, first, whether there is a keyboard-on event is detected (step 201). For detecting whether there is a keyboard-on event, key data indicating ON/OFF states of the respective keys are obtained by scanning the keyboard 2 via the key scan circuit 16, and bit sequences corresponding to the respective keys are read in as new key data.

Subsequently, old key data read in last time in the same manner and already stored in the RAM 12 is compared with the above-mentioned new key data to detect whether different bits exist. Then, if different bits exist, it is recognized that a key event has occurred, and an event map is created in which a bit corresponding to a key with a change is set to be ON.

Moreover, a judgement as to whether there is a key event is performed by examining the key event map. That is, if a bit that is ON does not exist in the key event map, it is recognized that no key event has occurred, and the processing returns to the main routine by returning from the keyboard event processing routine.

On the other hand, if a bit that is ON exists in the key event map, it is recognized that a key event has occurred, and subsequently, whether being an on-event of a key is judged. This is performed by detecting whether being on about a bit in the above-mentioned new key data corresponding to the above-mentioned bit that is ON in the key event map.

Next, whether the voice assist mode has been entered is detected with keyboard-on (step 202), and if it is in the voice assist mode, voice assistance (voice speech) is performed, a processing of a setting change regarding tone selection or a sound setting is performed (step 203).

In the processing of a setting change regarding tone selection or a sound setting, voice data corresponding to the setting item stored in advance in the setting item name storing unit 4 is spoken. The voice data is composed of words indicating the content of each setting item, as described above.

Also, the speech of voice data is performed after an emission of a sample sound of a phrase stored in the setting item name storing unit 4 in advance.

Next, if it is not in the voice assist mode, whether the operation button 1 has been depressed is detected with keyboard-on (step 204), and if the operation button 1 has been depressed, a count for operation button 3-second holding is stopped, and only the sound preview function is performed to establish the content of the setting change regarding tone selection or a sound setting (step 205).

In the processing of a setting change regarding tone selection or a sound setting, a sample sound of a phrase stored in advance in the phrase storing unit 4 is emitted. Also, because the phrase is provided, as described above, according to a changed state of the setting change, as a chordal Arpeggio or pitches by which the influence of the changed state is easily known, the changed state can be easily aurally confirmed.

Figure 8:
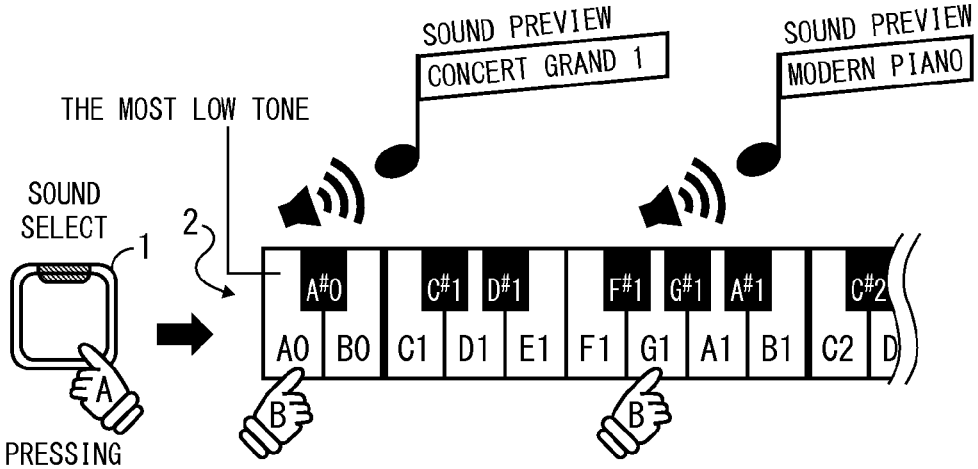
FIG. 8 is a model view for describing a sound preview function when a setting item is changed.

Specifically, as shown in FIG. 8, when the operation button (sound select key) 1 is pressed by a finger (operation A) while depressing a key A0 of the keyboard 2 by a finger (operation B), because the key A0 corresponds to a piano sound of a "concert grand 1" in the tone selection, the "concert grand 1" is set as a tone, and an Arpeggio consisting of C4, E4, G4, and C5 pitches (playing a chord of do, mi, sol, and do in order from the low-pitched tone) by the piano sound of the "concert grand 1" is emitted as a sound preview.

Also, when the operation button (sound select key) 1 is pressed by a finger (operation A) while depressing a key G1 of the keyboard 2 by a finger (operation B), because the key G1 corresponds to a piano sound of a "modern piano" in the tone selection, the "modern piano" is set as a tone, and an Arpeggio consisting of C4, E4, G4, and C5 pitches (playing a chord of do, mi, sol, and do in order from the low-pitched tone) by the piano sound of the "modern piano" is emitted as a sound preview.

Also, in step 204, if the operation button 1 has not been depressed, a musical sound production processing based on a performance action of musical sound data created by the key position in the keyboard 2 and the strength of a depression is performed (step 206).

Next, returning to FIG. 5, an operation button 3-second holding processing is performed (step 300) subsequent to the keyboard event processing.

Figure 9:
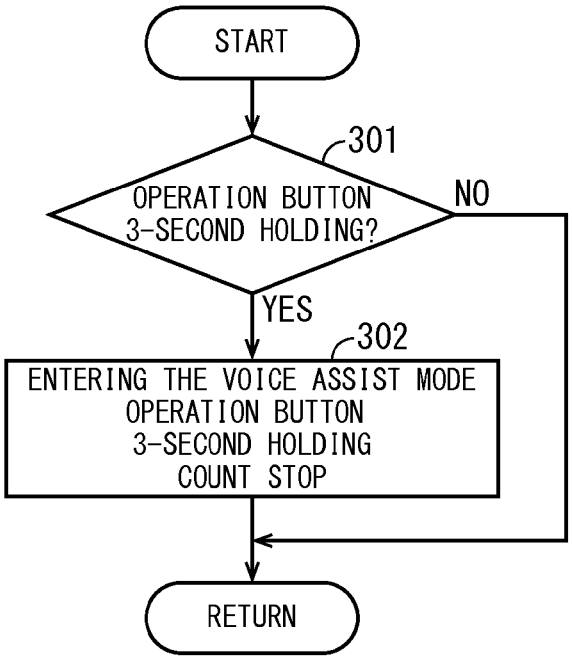
FIG. 9 is a flowchart showing a procedure of an operation button 3-second holding processing in the voice assist device.
Figure 10:
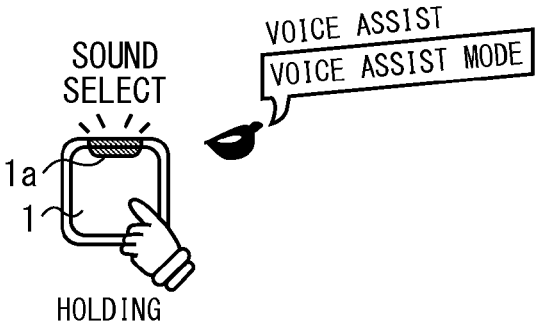
FIG. 10 is a model view for describing a voice assist function when a voice assist mode is entered.

In the operation button 3-second holding processing, as shown in FIG. 9, whether the operation button 1 has been held for three seconds is judged, and if there is a 3-second hold, the voice assist mode is entered, and the count for 3-second holding of the operation button 1 stops (step 302). Moreover, at this point in time, as shown in FIG. 10, the sound emitting unit 5 speaks a voice sound "voice assist mode," and a monitor unit 1*a* provided in the operation button 1 flashes.

By notifying by speech that a voice assist mode is applied and the monitor unit 1*a* flashing, it can be recognized that pressing a key in this state allows receiving voice assistance in which a setting item name corresponding to the key is emitted.

Also, when the voice assist mode is entered, the voice assist mode is maintained even if the physical depression of the operation button 1 is released, an objective setting item of a tone or sound setting or the like can be selected by depressing only a key of the keyboard 2.

In addition, after the operation button 1 is depressed, when a key of the keyboard 2 is pressed before an elapse of three seconds, the 3-second count stops, so that the voice assist mode is not entered even if the operation button 1 is thereafter continuously pressed.

Figure 11:
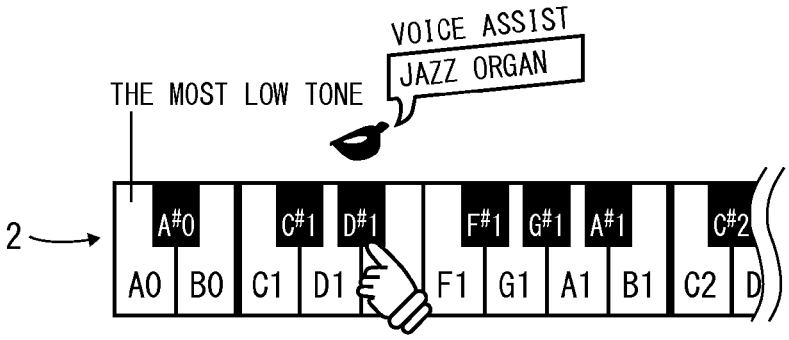
FIG. 11 is a model view for describing a voice assist function and a sound preview function when a setting item is emitted.

That is, as shown in FIG. 11, when any key (in the case of FIG. 11, a key D#1) of the keyboard 2 is depressed in the voice assist mode, after a phrase by a sound preview (because this case is for a tone setting, an Arpeggio consisting of C4, E4, G4, and C5 pitches) is emitted, a setting item name (jazz organ) assigned to the key D#1 is spoken.

In addition, when the operation button 3-second holding processing ends, "other processings" are subsequently performed (step 400). In the "other processings," for example, a transmission/reception processing etc., of MIDI data is performed via the MIDI interface circuit 15. Thereafter, the processing returns to the operation button event processing in step 100, and in the following, the same processings are repeated.

By the voice assist device described above, because voice assistance of reading out by voice the content of a setting item corresponding to a key is performed when changing tone selection or a sound setting in an electronic musical instrument, the content of an objective setting change can be aurally confirmed.

The voice assistance is not performed at all times when the operation button 1 is held, but requires a 3-second or more hold, and can therefore provide a user with support by speaking voice data only when the user has trouble operating.

Once the user has become accustomed to the operation to change setting items and does not become confused as to which settings have been assigned to which keys, the holding time of the operation button 1 is less than three seconds, which eliminates the trouble of hearing voice to enable a quick operation, without entering the voice assist mode.

Also, as a result of having the sound preview function, because a phrase of a sample sound is emitted when tone selection or a sound setting is changed, a change in sound due to the setting change can be easily aurally confirmed instantaneously.

Also, because a phrase (chordal Arpeggio or pitches) corresponding to the content of a setting (changed state) stored in advance in the phrase storing unit 4 is emitted, a difference of a change in settings can be more easily recognized than by a player's own play.

Also in an electronic musical instrument of a type without an operation panel to display the contents of settings, having performed a change can be reliably recognized concerning a change in tone selection or sound settings.

In the voice assist device described above, sound selection or a sound setting is performed by a depression of the operation button 1 and a key of the keyboard 2, however, the present invention can also be applied to where selection of the title of a musical composition (including an etude) to be automatically played in an electronic musical instrument and/or various operation settings regarding an electronic musical instrument (for example, time until the power is automatically turned off) are performed.

In this case, composition titles and/or the contents of operation are stored as voice data in the setting item name storing unit 4, and based on a depression of a key of the keyboard 2, the title of a composition (including an etude) is spoken when a musical composition to be automatically played is selected, and in the case of the various operation settings regarding an electronic musical instrument, for example, voice data such as "automatic power off 30 minutes" is spoken.

The invention claimed is:

1. A voice assist device comprising: in an electronic musical instrument which includes a keyboard and an operation button to perform various settings and for which an operation setting corresponding to a key is performed in advance by pressing the operation button while pressing one of the keys in the keyboard, a changed state recognizing unit that recognizes from a pressed key a changed state of an operation setting determined corresponding to the key in advance;

a setting item name storing unit that stores a setting item name of the operation setting as voice data; and a sound emitting unit that emits a setting item name corresponding to the changed state, said changed state recognizing unit including a voice assist recognizing unit that detects a depression for a preset time or more of the operation button prior to a depression of the key, said sound emitting unit emitting the setting item name when the depression is detected.

2. A voice assist device comprising: in an electronic musical instrument which includes a keyboard and an operation button to perform tone selection or a sound setting and in which tone selection or a sound setting corresponding to a key is performed in advance by pressing the operation button while pressing one of the keys in the keyboard, a changed state recognizing unit that recognizes from a pressed key a changed state of tone selection or a sound setting determined corresponding to the key in advance;

a setting item name storing unit that stores a setting item name of the tone selection or sound setting as voice data; and a sound emitting unit that emits a setting item name corresponding to the changed state, said changed state recognizing unit including a voice assist recognizing unit that detects a depression for a preset time or more of the operation button prior to a depression of the key, said sound emitting unit emitting the setting item name when the depression is detected.

3. The voice assist device according to claim 1, wherein the sound emitting unit notifies that a voice assist mode is applied when a depression for a preset time or more of the operation button is detected.

4. The voice assist device according to claim 2, wherein the sound emitting unit notifies that a voice assist mode is applied when a depression for a preset time or more of the operation button is detected.

5. The voice assist device according to claim 3, wherein the notification is performed by speech.

6. The voice assist device according to claim 1, wherein the preset time is three seconds.

7. The voice assist device according to claim 2, wherein the preset time is three seconds.

8. The voice assist device according to claim 2, comprising a phrase storing unit in which phrases of sounds by which an influence of the changed state is easily known are stored in plural numbers according to the changed state, wherein the sound emitting unit emits a phrase corresponding to the changed state, and thereafter emits a setting item name of the tone selection or sound setting.

9. A voice assist program stored on a non-transitory computer-readable medium, said program provides instructions for making a computer build the functions of the respective units according to claim 1.

10. A voice assist program stored on a non-transitory computer-readable medium, said program provides instructions for making a computer build the functions of the respective units according to claim 2.

* * * * *